US006732406B2

(12) United States Patent
Oh

(10) Patent No.: US 6,732,406 B2
(45) Date of Patent: May 11, 2004

(54) UPRIGHT TYPE VACUUM CLEANER

(75) Inventor: Jang-keun Oh, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 237 days.

(21) Appl. No.: 10/028,404

(22) Filed: Dec. 21, 2001

(65) Prior Publication Data

US 2002/0088079 A1 Jul. 11, 2002

(30) Foreign Application Priority Data

Jan. 11, 2001 (KR) ..... 2001-1617

(51) Int. Cl.[7] ..... A47L 9/16

(52) U.S. Cl. ..... 15/352; 15/353; 55/337; 55/426; 55/459.1; 55/DIG. 3

(58) Field of Search ..... 15/347, 350, 351, 15/352, 353; 55/337, 426, 429, 459.1, DIG. 3

(56) References Cited

U.S. PATENT DOCUMENTS 2,542,635 A * 2/1951 Davis et al. ..... 55/399
4,172,710 A 10/1979 van der Molen
5,230,722 A * 7/1993 Yonkers ..... 55/337
6,146,434 A 11/2000 Scalfani et al.
6,532,620 B2 * 3/2003 Oh ..... 15/353

FOREIGN PATENT DOCUMENTS

| | | |
|---|---|---|
| EP | 0928594 | 7/1999 |
| WO | WO 0074547 | 12/2000 |
| WO | WO 00/74548 | * 12/2000 |

* cited by examiner

*Primary Examiner*—Terrence Till
(74) *Attorney, Agent, or Firm*—Ladas & Parry

(57) ABSTRACT

An upright type vacuum cleaner has a separately removable dust barrel. The vacuum cleaner includes a suction brush and a cleaner body having a dust chamber, a motor driving chamber housing a motor, an air inflow path, and an air outflow path for interconnecting the upper dust chamber and the lower motor driving chamber. A cyclone body is mounted in the dust chamber, and a dust barrel removably mounted to a lower side of the cyclone body. The vacuum cleaner further includes a fine dust filtering portion removably disposed in the air outflow path. The vacuum cleaner also includes a locking/unlocking portion that detaches the dust barrel from the cyclone body. Accordingly, a user can dispose of collected contaminants and dust without having to remove the entire cyclone dust collecting apparatus, but rather by removing only the dust barrel from the dust chamber.

14 Claims, 6 Drawing Sheets

UPRIGHT TYPE VACUUM CLEANER

BACKGROUND OF THE INVENTION

1. Field of the Invention

The present invention relates to an upright type vacuum cleaner having a cyclone dust collecting apparatus, and more particularly, to an upright type vacuum cleaner having a cyclone dust collecting apparatus and a removable dust barrel.

2. Description of the Related Art

Generally, an upright type vacuum cleaner having a cyclone dust collecting apparatus has a suction brush that is connected to a cleaner body and moved along a cleaning surface. The interior of the cleaner body is divided into a dust collecting chamber, in which the cyclone dust collecting apparatus is removably installed, and a motor driving chamber, in which a motor is installed. During operation, the motor generates a strong suction force at the suction brush. The suction force draws air and contaminants on the cleaning surface into the cleaner body. After being drawn in through the suction brush, the air and contaminants are drawn into the cyclone dust collecting apparatus, installed in the dust collecting chamber of the cleaner body. The cyclone dust collecting apparatus guides the air into a vortex that whirls at a high speed. The vortex of air has a centrifugal force, by which the contaminants are separated from the air. The contaminants are then collected in the cyclone dust collecting apparatus, and the clean air is discharged out through the motor driving chamber.

As shown in FIG. 1, the cyclone dust collecting apparatus 10 includes a cyclone body 11 and a cyclone housing 12. The cyclone housing 12 includes a centrifugal separating chamber 12*a* and a dust barrel 12*b*. The centrifugal separating chamber 12*a* has an opening that interconnects the centrifugal chamber 12*a* with the dust barrel 12*b*. Accordingly, the air drawn into the cyclone body 11 forms the vortex current in the centrifugal separating chamber 12*a*. By the centrifugal force of the vortex air, the contaminants are separated from the air, and guided into the dust barrel 12*b* through the opening 12*c*. Thus, the contaminants are collected in the dust barrel 12*b*.

The process of emptying the cyclone dust collecting apparatus 10 of the upright type vacuum cleaner, when it is full with contaminants and dust, will be described below. First, the cyclone dust collecting apparatus 10 is removed from the dust chamber. Next, the cyclone housing 12, which holds the contaminants and dust, is separated from the cyclone body 11 of the cyclone dust collecting apparatus 10. The user then dumps the contaminants and dust from the dust barrel 12*b* of the cyclone housing 12 into a dustbin.

The arrangement described above is inconvenient for a user, since the user has to first separate the cyclone dust collecting apparatus 10 from the dust chamber and then separate the dust barrel 12*b* from the cyclone housing 12 in order to empty the dust barrel 12*b* of the cyclone housing 12.

SUMMARY OF THE INVENTION

The present invention has been made to overcome the above-described problems of the related art. Accordingly, it is an object of the present invention to provide an upright type vacuum cleaner having a cyclone dust collecting apparatus enabling a user to dump contaminants collected therein easily without separating the entire cyclone dust collecting apparatus from the vacuum cleaner. The user need only remove the dust barrel, which holds the contaminants, from the vacuum cleaner in order to dispose of the contents in the dust barrel.

The above object is accomplished by an upright type vacuum cleaner including a cleaner body having an upper dust chamber, a lower motor driving chamber housing a motor, and an air inflow path and an air outflow path for interconnecting the upper dust chamber and the lower motor driving chamber. The vacuum cleaner further includes a cyclone body mounted in an upper portion of the dust chamber, and a dust barrel removably mounted on a lower side of the cyclone body. The cyclone body is connected with the air inflow path and the air outflow path. A suction brush, which is mounted on a lower portion of the cleaner body, is movable along a cleaning surface. The vacuum cleaner further includes fine dust filtering means removably disposed on the air inflow path and the air outflow path.

The cyclone body includes a cover having an open end and a closed end, and a contaminant discharge port formed in the closed end. The cyclone body also includes a head portion having an air inflow pipe connected to the air inflow path for guiding the air in a diagonal direction with respect to the cover, an air outflow pipe having one end connected to a grille that extends toward the closed end of the cover and is connected to the air outflow path.

The closed end of the cover preferably includes a spiral surface. Also, the dust barrel is substantially cylindrical in shape and has an open end and a closed end. The open end of the dust barrel aligns with the closed end of the cyclone body.

BRIEF DESCRIPTION OF THE DRAWINGS

The above objects and other features and advantages of the present invention will be clarified by the following description with the attached drawings, in which.

DETAILED DESCRIPTION OF THE PREFERRED EMBODIMENT

Figure 1:
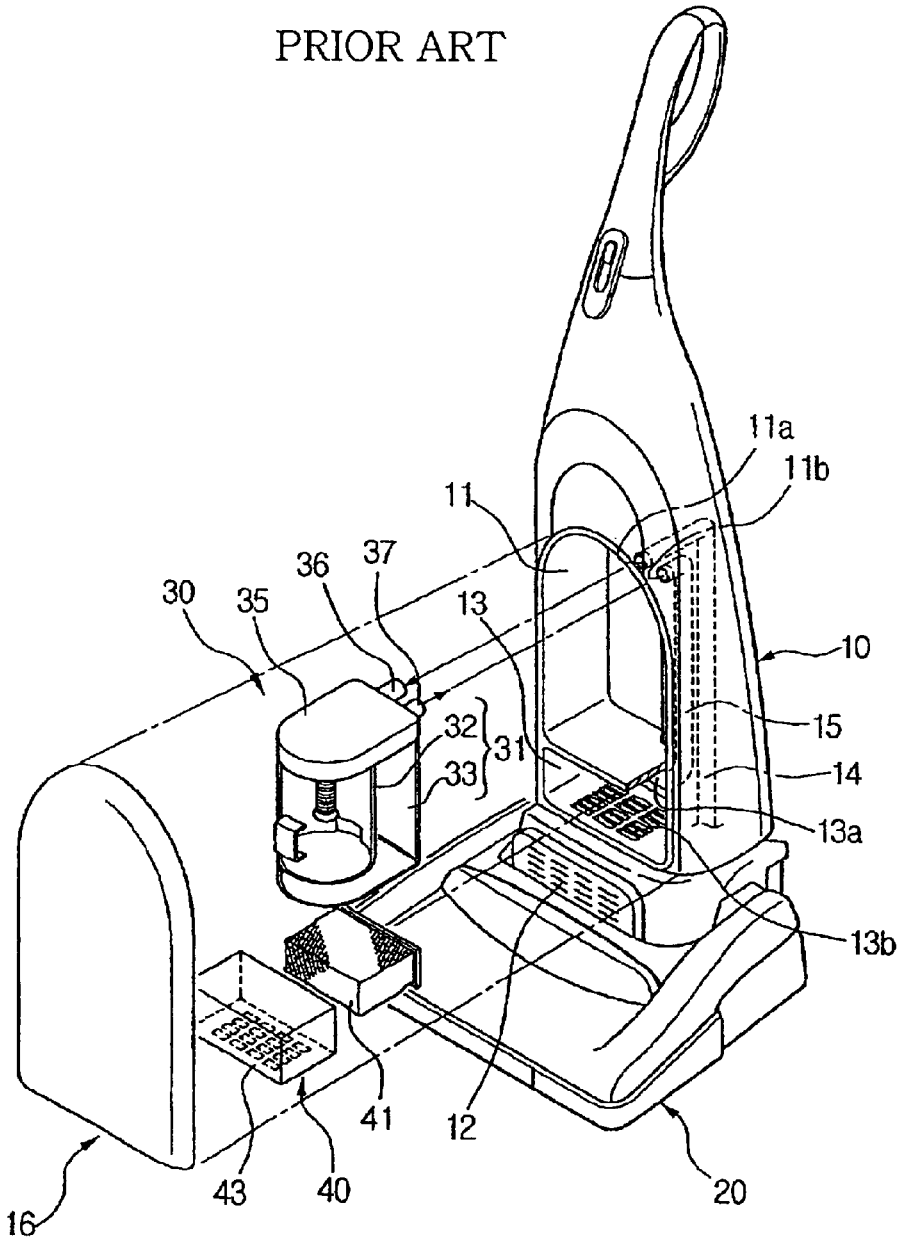
FIG. 1 PRIOR ART
FIG. 1 is a perspective view of a cyclone dust collecting apparatus employed in a conventional upright type vacuum cleaner.
Figure 2:
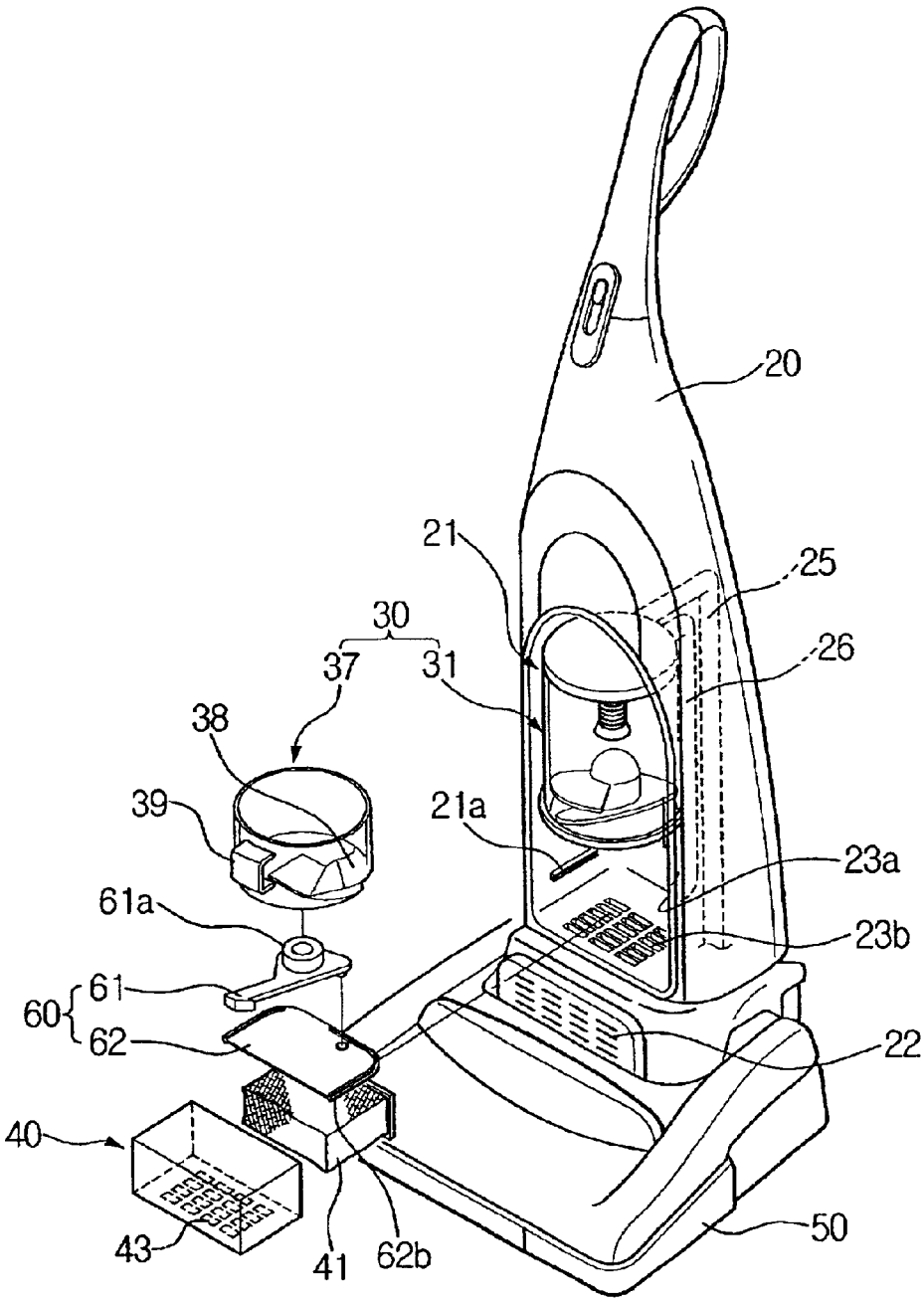
FIG. 2 is a perspective view of an upright type vacuum cleaner including a cyclone dust collecting apparatus in accordance with the present invention.

Referring to FIG. 2, an upright vacuum cleaner includes a cleaner body 20, a suction brush 50 mounted on a lower side of the cleaner body 20, a cyclone dust collecting apparatus 30 removably mounted in the cleaner body 20, and a filtering means 40 for filtering fine dust and contaminants.

The cleaner body 20 includes a dust chamber 21 for housing the cyclone dust collecting apparatus 30, a motor driving chamber 22 for housing a motor (not shown), and a filter chamber 23 for housing the filtering means 40. The cyclone dust collecting apparatus 30 is connected to an end of an inflow path 25 formed in the cleaner body 20 and to an end of a discharge path 26. The other end of the inflow path 25 is in communication with the suction brush 50. Accordingly, air and the contaminants entrained in the air are drawn from the cleaner surface into the cyclone dust collecting apparatus 30 through the inflow path 25. Further, the other end of the discharge path 26 is connected to the motor driving chamber 22. The filter chamber 23 is provided in the discharge path 26. Accordingly, when the air is discharged from the cyclone dust collecting apparatus 30, the air flows through the discharge path 26, the filter chamber 23, and the motor driving chamber 23, to the outside. The filter chamber 23 includes an air inlet 23*a*, corresponding to the discharge path 26, and an air outlet 23*b*, corresponding to the motor driving chamber 22. The air inlet 23*a* is formed on an inner side of the filtering chamber 23, while the air outlet 23*b* is formed on a bottom of the filtering chamber 23.

The suction brush 50 is mounted on a lower side of the cleaner body 20 and is movable along the cleaning surface. The vacuum cleaner motor, which is in the motor driving chamber 22, generates a suction force, so that the suction brush draws in the ambient air together with fine dust and contaminants from the cleaning surface. It is preferable that the suction brush 50 is movably mounted on the cleaner body 20.

Figure 3:
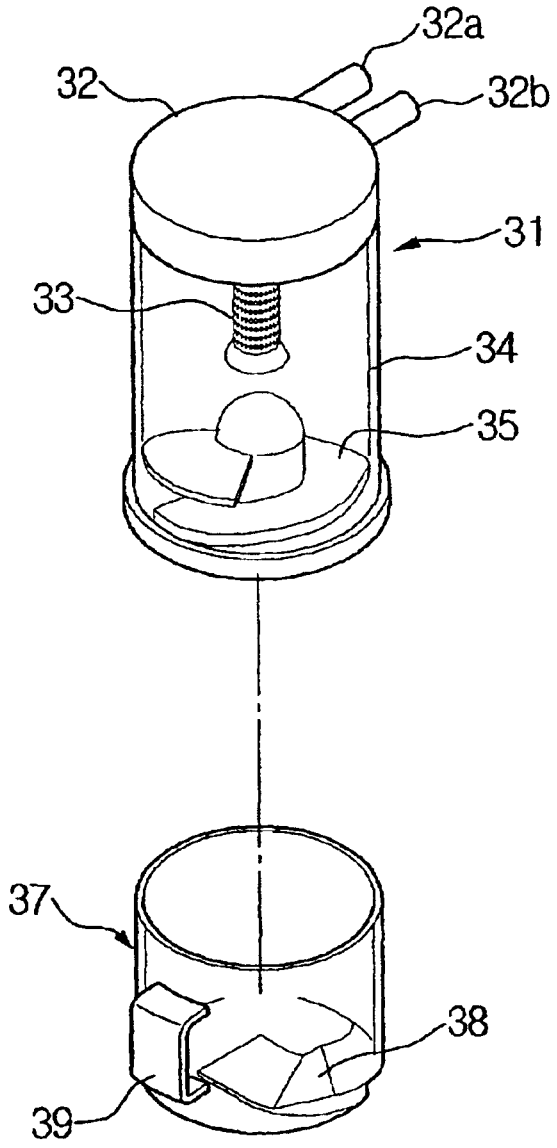
FIG. 3 is an exploded perspective view of the cyclone dust collecting apparatus shown in FIG. 2.

The cyclone dust collecting apparatus 30 includes a cyclone body 31 and a dust barrel 37. FIG. 3 provides a more detailed illustration of the cyclone dust collecting apparatus 30. The cyclone body 31 includes a head portion 32 and a cover 34. The head portion 32 includes an inflow pipe 32*a* connected to the inflow path 25, a discharge pipe 32*b* connected to the discharge path 26, and a grille 33 for filtering the dust. The head portion 32 is connected to an upper end of the cover 34. While one end of the inflow pipe 32*a* is connected to the inflow path 25, the other end of the inflow pipe 32*a* is formed so as to discharge the air in a diagonal direction with respect to the cover 34. The grille is substantially cylindrical in shape and extends down toward a closed end of the cover 34. The grille has a plurality of fine holes formed in its surface.

The cover is also substantially cylindrical in shape and has an open end and a closed end. A contaminant discharge port is formed in the closed end of the cover 34. The contaminant discharge port may be an opening of a predetermined size, or more preferably, a spiral surface 35 along which the contaminants can be discharged to the dust barrel 37 smoothly. A starting edge and an ending edge of the spiral surface 35 may be arranged on a same point, or the starting side may overlap a certain area of the ending side.

Here, it is preferable that the cyclone body 31 is secured to the dust chamber 21 by a separate fastening member (not shown).

The dust barrel 37 is substantially cylindrical in shape and has an open end and a closed end. The open end of the dust barrel 37 aligns with the closed end of the cyclone body 31. It is preferable that a handle 39 is formed on a sidewall of the dust barrel 37 to facilitate handling of the dust barrel 37.

Figure 6:
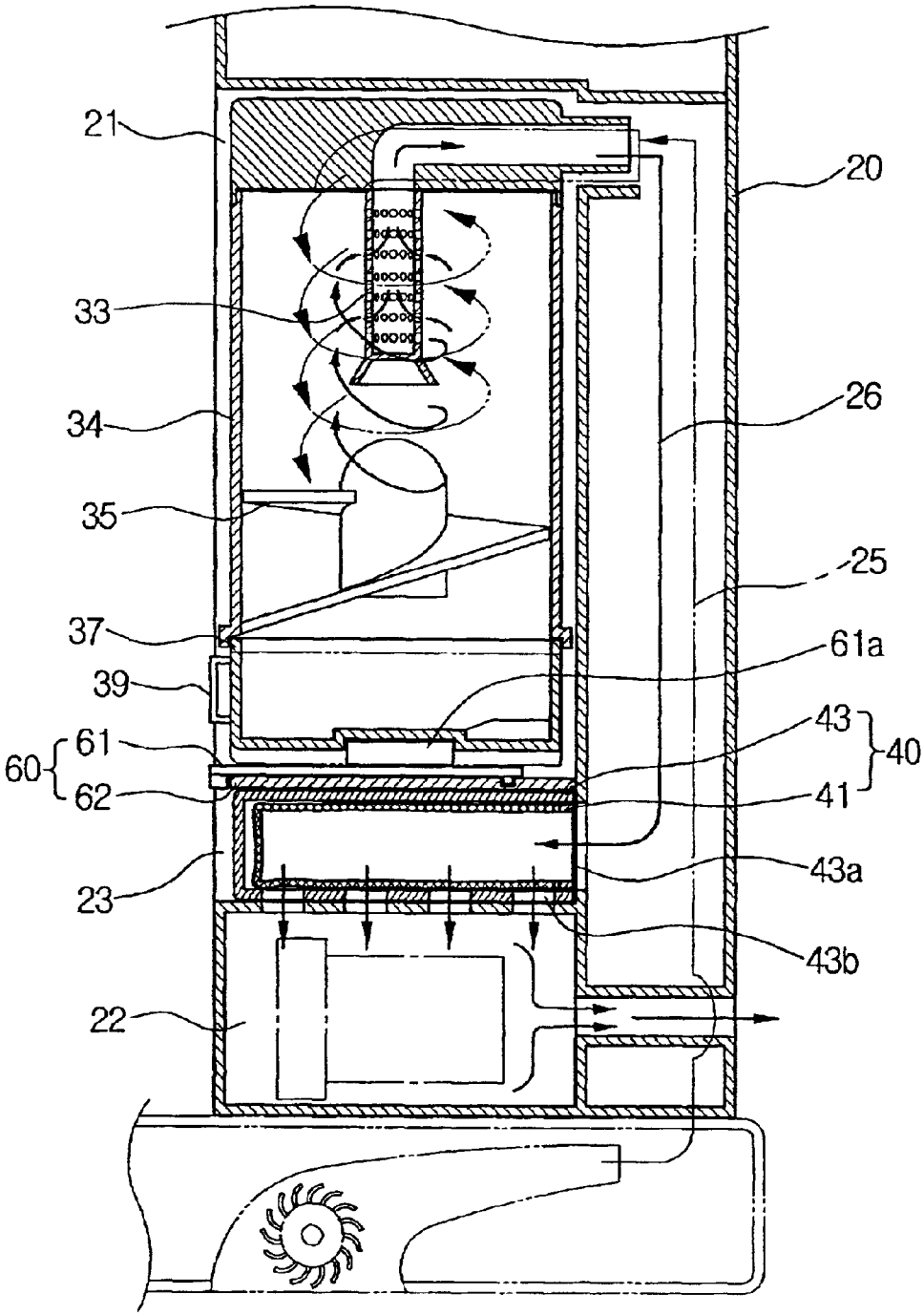
FIG. 6 is a partial sectional view showing the upright type vacuum cleaner of FIG. 2.

Referring back to FIG. 2, the filtering means 40 includes an air filter 41 and a filter casing 43. The air filter 41 is formed of a material having a plurality of fine holes to filter fine dust particles, which were not separated out by the cyclone dust collecting apparatus 30. Any conventional air filter for a vacuum cleaner may serve the function of the air filter 41, and accordingly, the detailed description thereof is omitted. The filter casing 43 houses the air filter 41 and is removably disposed in the filter chamber 23. The filter casing 43 includes an inflow port 43*a* (FIG. 6) connected to the discharge path 26, and an outflow port 43*b* (FIG. 6) connected to the motor driving chamber 22. Accordingly, the inflow port 43*a* of the filter casing 43 corresponds to the air inlet 23*a* of the filtering chamber 23, while the outflow port 43*b* thereof corresponds to the air outlet 23*b*.

Figure 4:
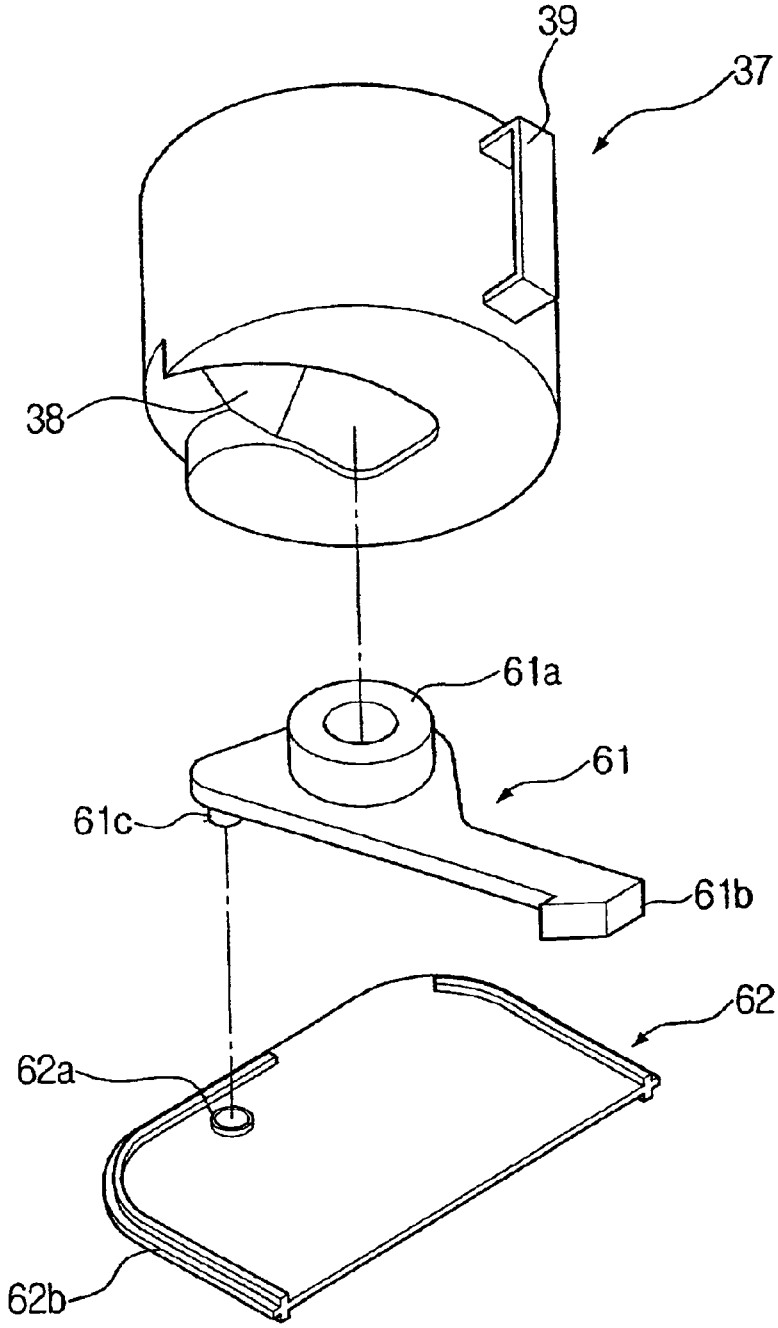
FIG. 4 is an exploded perspective view of a locking/unlocking means for the cyclone dust collecting apparatus of FIG. 2.

The dust chamber 21 includes a locking/unlocking means 60 for mounting and removing the dust barrel 37 from the cyclone dust collecting apparatus 30. The locking/unlocking means 60, which is best illustrated in FIG. 4, includes a slanted recess 38 formed on a lower end of the dust barrel 37, a fixing member 61 having a protrusion 61*a* that is received in the slanted recess 38, and a base 62 for supporting fixing member 61 and the cyclone dust collecting apparatus 30. The base 62 supports the fixing member 61 for movement of the fixing member 61 with respect to the slanted recess 38.

The slanted recess 38 is formed in a spiral fashion and has a depth that gradually increases from a center of the lower end of the dust barrel 37 to an outer edge of the lower end.

The fixing member 38 includes a rotary pin 61*c*, a rotary handle 61*b* and the protrusion 61*a*. The rotary pin 61*c* is formed on one end of the fixing member 61 and serves as a pivot. The rotary handle 61*b* is formed at the other end of the fixing member 61, and the protrusion 61*a* is located between the two ends. The protrusion 61*a* extends upward from the base 62 to engage the slanted recess 38.

The base 62 includes a connecting protrusion 62*b* corresponding to a guide protrusion (not shown) formed on an inner wall of the dust chamber 21 for removably mounting the base 62 in the dust chamber 21. The base 62 also has a hole 62*a* formed therein. The hole 62*a* receives the rotary pin 61*c* of the fixing member 61.

Accordingly, when the user turns the rotary handle 61*b* of the fixing member 61 to a predetermined direction (counterclockwise direction in FIG. 5A), the fixing member 61 pivots about the rotary pin 61*c*, and the protrusion 61*a* moves along the slanted recess 38. Accordingly, as shown by the dotted line in FIG. 6, the dust barrel 37 is lowered to a position where the dust barrel 37 is disengaged from the cyclone body 31.

Albeit not shown, the locking/unlocking means 60 can be formed into various designs.

The operation of the upright type vacuum cleaner constructed as above according to the preferred embodiment of the present invention will be described below.

First, when the motor of the motor driving chamber 22 operates, a suction force is generated at the suction brush 50. The suction force enables the suction brush 50 to draw ambient air and contaminants and dust on the cleaning surface into the cyclone body 31 through the inflow path 25. The air is guided through the inflow path 32*a* in a diagonal direction along the inner circumference of the cover 34, forming a vortex of air. During this process, the centrifugal force of the vortex of air separates the contaminants and dust from the air. The dust and contaminants pass along the spiral surface 35 and are discharged to the dust barrel 37. Such separated contaminants and dust are received and collected in the dust barrel 37. The spiral surface 35 of the cover 34 prevents a backflow of the contaminants and dust from re-entering the cover 34.

Meanwhile, the cleaner air is passed through the fine holes of the grille 33 of the head portion 32 and is discharged through the discharge pipe 32*b*. Then the air flows through the discharge pipe 32*b* and the discharge path 26 into the filter casing 43 of the filter chamber 23. In the filter casing 43, fine dust particles in the air, which were not separated out by the cyclone dust collecting apparatus 30, are filtered out at the air filter 41, and the clean air is drawn into the motor driving chamber 23 and discharged outside.

Next, the process of removing and re-inserting the dust barrel 37 will be described.

Figure 5A:
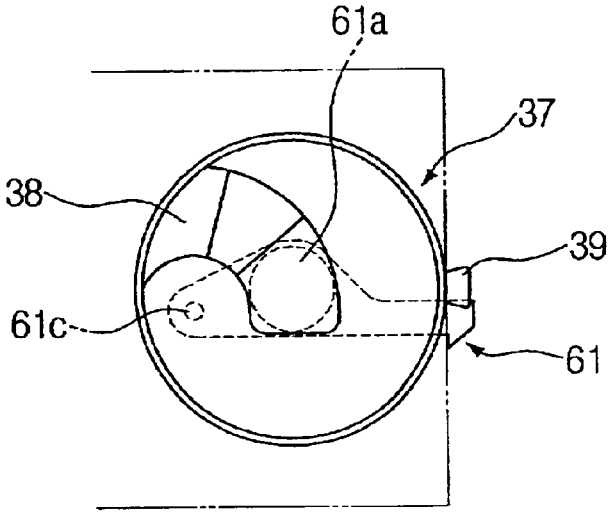
FIGS. 5A and 5B are sectional views showing the operation of the locking/unlocking means of FIG. 2.
Figure 5B:
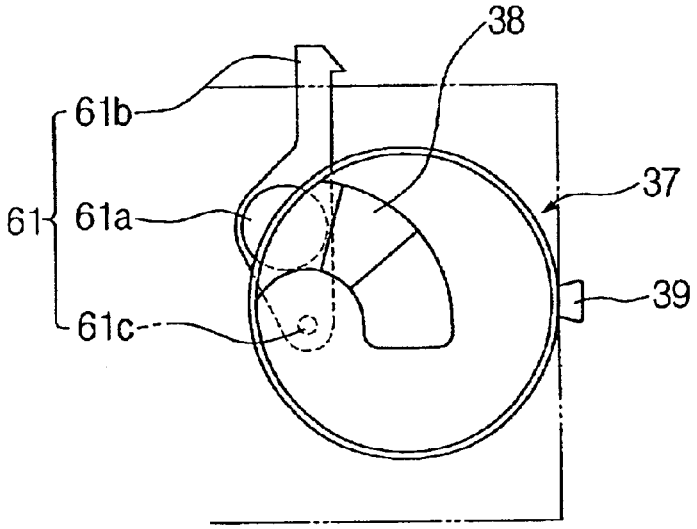

When the dust barrel 37 is full of contaminants and dust, the user grabs the handle 61*b* of the fixing member 61 and turns the fixing member in a counterclockwise direction, from the position shown in FIG. 5A to that shown in FIG. 5B. Accordingly, the protrusion 61*a* of the fixing member 61 is moved along the slanted recess 38 from the center to the outer edge of the dust barrel 37. As described above, since the depth of the slanted recess 38 increases from the center to the outer edge of the dust barrel 37, when the protrusion 61*a* of the fixing member 61 reaches the end of the slanted recess 38 adjacent to the outer edge of the dust barrel 37, the dust barrel 37 is lowered and thus separated from the cyclone body 31.

The user then grabs the handle 39 of the dust barrel 37 to remove the dust barrel 37 from of the dust chamber 21 and dispose of the contaminants and dust that have collected in the dust barrel 37.

In order to clean an interior of the dust chamber 21, the user can pull out the base 62 together with the dust barrel 37 and the fixing member 61.

Meanwhile, in order to re-insert the dust barrel 37 in the dust chamber 21, the user mounts the base 62 in the dust chamber 21 and then mounts the fixing member 61 on the base 62, by aligning and inserting the rotary pin 61*c* to the hole 62*b* of the base 62. Then the user aligns the protrusion 61*b* of the fixing member 61 with the slanted recess 38 and mounts the dust barrel 37 on the fixing member 61.

Then the user grabs the handle 61*b* and turns the fixing member in a clockwise direction from the position shown in FIG. 5B to that shown in FIG. 5A. Accordingly, by the movement of the protrusion 61 along the slanted recess 38 to raise the dust barrel 37 into connection with the cyclone body 31.

As described above, the upright type vacuum cleaner of the present invention simplifies disposal of collected contaminants and dust, since the user does not have to separate the entire cyclone dust collecting apparatus 30 from the dust chamber 21. Instead, the user only has to separate the dust barrel, which actually holds the contaminants and dust, from the cyclone dust collecting apparatus 30.

Although the preferred embodiment of the present invention has been described, it will be understood by those skilled in the art that the present invention should not be limited to the described preferred embodiment. Various changes and modifications can be made within the spirit and scope of the present invention as defined by the appended claims.

What is claimed is:

1. An upright type vacuum cleaner, comprising:

a cleaner body having an upper dust chamber, a lower motor driving chamber housing a motor, an air inflow path, and an air outflow path for interconnecting the upper dust chamber and the lower motor driving chamber;

a cyclone body mounted in an upper portion of the dust chamber and connected to the air inflow path and the air outflow path, and including a cover having an open end and a closed end;

a dust barrel removably mounted to a lower side of the cyclone body;

locking/unlocking means for connecting to or separating the dust barrel from the closed end of the cover of the cyclone body by raising or lowering the dust barrel in the dust chamber;

a suction brush mounted on a lower portion of the cleaner body, movable along a cleaning surface; and fine dust filtering means removably disposed in the air outflow path.

2. The vacuum cleaner of claim 1, wherein the dust barrel is substantially cylindrical in shape and has an open end and a closed end, the open end aligning with the closed end of the cover.

3. The vacuum cleaner of claim 1, wherein the dust barrel includes a handle formed on a sidewall thereof.

4. The vacuum cleaner of claim 1, wherein the locking/unlocking means comprises: a slanted surface formed on the closed end of the dust barrel, the slanted surface extending in a curve and gradually increasing in depth from a center of the dust barrel to an outer edge of the dust barrel; a fixing member including a rotary pin formed proximate a first end, a handle located at a second end, and a protrusion located between the first and second ends, the protrusion being received in and movable along the slanted surface; and a base removably mounted in the dust chamber, the base having a hole formed therein for receiving the rotary pin and supporting movement of the fixing member with respect to the slanted surface.

5. The vacuum cleaner of claim 1, wherein the closed end of the cover is a spiral surface.

6. An upright type vacuum cleaner, comprising:

a cleaner body having an upper dust chamber, a lower motor driving chamber housing a motor, an air inflow path, and an air outflow path for interconnecting the upper dust chamber and the lower motor driving chamber;

a cyclone body mounted in an upper portion of the dust chamber and connected to the air inflow path and the air outflow path, wherein the cyclone body comprises:

a cover including an open end and a closed end, and a contaminant discharge port formed on the closed end of the cover; and a head portion including an air inflow pipe connected to the air inflow path for guiding the air in a diagonal direction with respect to the cover, an air outflow pipe having one end connected to a grille, the grille extending toward the closed end of the cover and being connected to the air outflow path;

a dust barrel removably mounted to a lower side of the cyclone body;

a suction brush mounted on a lower portion of the cleaner body, movable along a surface to be cleaned; and fine dust filtering means removably disposed in the air outflow path.

7. The vacuum cleaner of claim 6, wherein the closed end of the cover is a spiral surface.

8. The vacuum cleaner of claim 6, wherein the dust barrel is substantially cylindrical in shape and has an open end and a closed end, the open end aligning with the closed end of the cover.

9. The vacuum cleaner of claim 6, wherein the dust barrel includes a handle formed on a sidewall thereof.

10. An upright type vacuum cleaner comprising: a cleaner body including a dust chamber, a motor driving chamber, an air inflow path, and an air outflow path, the air outflow path connecting the dust chamber with the motor driving chamber, a suction brush pivotally coupled to the cleaner body; a cyclone body mounted in the dust chamber in communication with the air inflow path and the air outflow path, the cyclone body including a head portion and a cover, the head portion including a grille extending toward a closed end of the cover, the closed end of the cover having a spiral surface forming a contaminant discharge port; and a removable dust barrel coupled to closed end of the cyclone body.

11. The vacuum cleaner of claim 10, wherein each of the cover of the cyclone body and the dust barrel is substantially cylindrical in shape.

12. The vacuum cleaner of claim 10, wherein the dust barrel has a handle formed on an outer sidewall thereof.

13. The vacuum cleaner of claim 10, wherein a curved, slanted surface is formed in a closed end of the dust barrel, the slanted surface extending from a center of the closed end to an outer edge of the dust barrel and gradually increasing in depth, and further comprising a connection assembly for connecting the dust barrel to the cyclone body, the connection assembly including: a fixing member having a first end and a second end, the fixing member including a pin located proximate the first end, a handle at the second end, and a protrusion located between the first and second ends, the protrusion extending upward and being received in the slanted recess of the dust barrel; and a base removably mounted in the dust chamber, the base having a hole formed therein for receiving the pin of the fixing member.

14. The vacuum cleaner of claim 10, further comprising a fine dust filter located in the air outflow path.

* * * * *